US006264043B1

(12) United States Patent
Mobley

(10) Patent No.: US 6,264,043 B1
(45) Date of Patent: Jul. 24, 2001

(54) SIZING TABLE EMPLOYING VARIABLE PITCH AUGUR

(75) Inventor: John E. Mobley, Redmond, OR (US)

(73) Assignee: Key Technology, Inc., Walla Walla, WA (US)

( * ) Notice: Subject to any disclaimer, the term of this patent is extended or adjusted under 35 U.S.C. 154(b) by 0 days.

(21) Appl. No.: 09/484,837

(22) Filed: Jan. 18, 2000

(51) Int. Cl.[7] ..... B07B 13/07

(52) U.S. Cl. ..... 209/669; 209/659; 209/660; 209/667; 209/670

(58) Field of Search ..... 209/659, 660, 209/667, 669, 670

*Primary Examiner*—Donald P. Walsh
*Assistant Examiner*—Mark J. Beauchaine
(74) *Attorney, Agent, or Firm*—Chernoff, Vilhauer, McLlung & Stenzel, LLP

(57) ABSTRACT

A sizing table for a product such as potatoes which sorts product according to its size includes a frame which supports a plurality of horizontally extending parallel rotary spindles. A first group of the spindles supports tapered rollers while a second group of spindles interposed in alternating fashion with the first group includes variable pitch augurs. A motor imparts rotary motion to both groups of spindles and drives the product down the table. When the pitch of the augur combined with the distance from the augur to the spindles increases sufficiently, product is allowed to drop through into selected bins or conveyors placed below the table.

10 Claims, 3 Drawing Sheets

SIZING TABLE EMPLOYING VARIABLE PITCH AUGUR

BACKGROUND OF THE INVENTION

The following invention relates to a sizing apparatus for sizing food product such as potatoes.

Food product such as potatoes is frequently processed so that similar sized pieces of product are grouped together. Thus, part of the task of preparing food product for further processing or distribution is to size the product properly so that large pieces of product are not mixed in with smaller ones and vice-versa. In the past, various types of graders have been used to properly size food products. An example of such a device is a roll size grader manufactured by Welliver Metall Products Corporation of Salem, Oreg.

The Welliver grader used a sizing table which employed conically shaped rollers which had a gradual taper from the input end of the roller of the table to the output end. This device is illustrated in FIG. 1. As can be seen from the figure, a set of tapered parallel rollers 2 extends from an input end of the table to an output end. Vanes in the form of spiral threads are included on every other roller 4 so that when product is deposited at the input end of the table the threads push it forward toward the output end, that is, from right to left. With the taper of the rollers becoming smaller from the input end to the output end, smaller food product near the input end then larger food product drops between the rollers to the conveyor belts 6 below. The problem with this size grader table is that it is incapable of grading food product in two dimensions. For example with potatoes, long thin potatoes will slip through the portion of the size grader intended only for smaller potatoes. Long thin potatoes do not process well into french fries and it would be desirable to remove these potatoes so that they are not mixed in with the other grades of product which have a more symmetrical shape.

Another problem with sizing tables having fixed sizing apertures is that they do not allow for variations in product or changes in the sizes of product. Product like potatoes can vary in size distribution depending upon agricultural factors such as rainfall in any given year. Thus, one year's harvest may yield large potatoes while the size distribution may be smaller the following year. Sizing tables such as the Welliver are fixed, however, and do not accommodate changes in product size distribution or even changes in the types of products processed.

BRIEF SUMMARY OF THE INVENTION

The present invention provides a sizing apparatus for sorting product according to its size and comprises a frame which supports a plurality of horizontally extending parallel rotary spindles. A first group of the spindles supports tapered rollers while a second group of the spindles interposed in an alternating fashion with the first group includes variable pitch augurs. A motor imparts rotary motion to both groups of spindles.

The rollers are tapered so that their diameters gradually decrease from the input end of the sizer to the output end. The augurs which have deep helical vanes so as to present a two dimensional aperture relative to the rollers have a pitch which increases progressively from the input end to the output end of the sizer. The pitch of the augurs can be made adjustable because the augurs are constructed in segments which fit together when each segment is placed on a rotating spindle. Each segment of the variable pitch augurs comprises a mounting portion which has an aperture for receiving a spindle shaft and a generally helically shaped blade portion where the blade portion of each segment extends for a radial length of between 90 degrees and 180 degrees. Preferably, the segments are 120 degree segments.

Since the augurs are constructed in segments, the pitch is continuously variable. The user may selectively construct augurs using segments of varying pitch to arrive at an overall sizing for the augur that can accommodate differing size distribution of the same product or different product altogether. The sizing table can therefore be changed or customized for product of variable size distribution.

The tapered rollers may also be adjusted for size and may be comprised of a set of frusto-conical segments which abut one another when they are threaded onto the spindles. The sizes of these rollers are selectively variable so that rollers may also be customized to complement the variations in the pitch of the augurs.

The augurs are situated adjacent the rollers and the space between the augur and each next adjacent roller defines an aperture through which only properly sized product can slip. Long skinny products cannot slip down into the space so defined because the pitch of the augurs is too fine near the input end even though the diameter of some of the product would be such that it could fit through these input openings. However, it is only near the output end that the pitch of the augurs becomes long enough to allow longer pieces of product (that is, longer along the major axis of the product) to slip between the threads of the augur and onto an appropriate conveyor or bin situated below the sizer table.

Thus, as the augurs turn, the food product is moved from one end of the sizing table to the other end, and properly sized product is allowed to drop at the appropriate point onto conveyors or bins located beneath the table which are grouped according to size.

DETAILED DESCRIPTION OF THE PREFERRED EMBODIMENT

Figure 1:
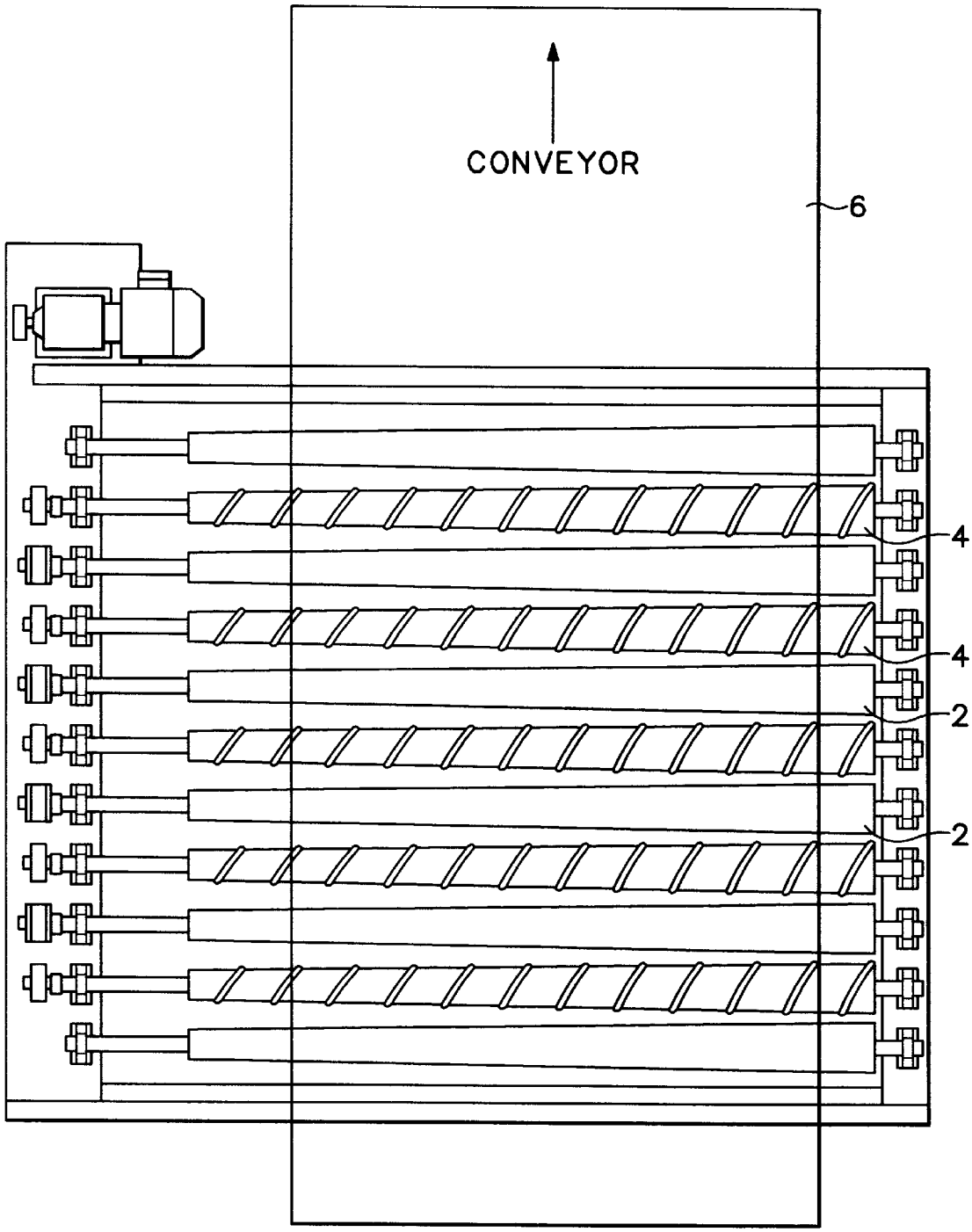
FIG.1 PRIOR ART
FIG. 1 is a plan view of a prior art sizing table.
Figure 2:
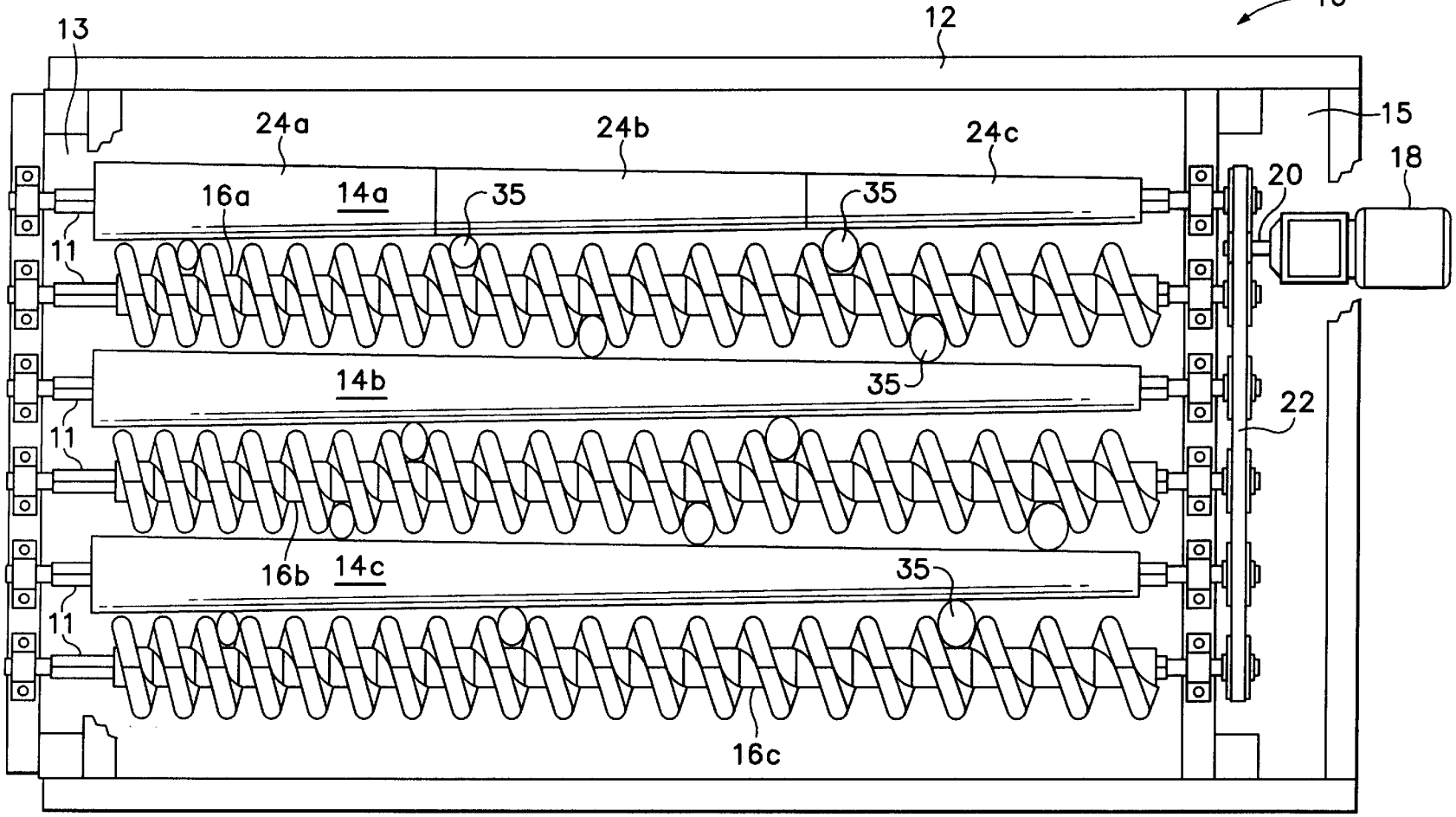
FIG. 2 is a plan view of a sizing table constructed according to the present invention.

Referring to FIG. 2, a sizing table 10 includes a frame 12 which supports a plurality of spindles 11. Three of the spindles support tapered conical rollers 14*a*, 14*b* and 14*c*. The other three spindles 11 support variable pitch augurs 16*a*, 16*b* and 16*c*. The spindles 11 are driven by a motor 18 having an output shaft 20 which is geared to a drive belt 22. Located underneath the sizing table 10 may be either conveyor belts for carrying properly sized product or bins (not shown), depending on the desires of the user.

Each of the conical rollers 14*a*, 14*b* and 14*c* may be comprised of a plurality of frusto-conical segments such as segments 24*a*, 24*b* and 24*c* which are three segments that together comprise roller 14*a*. Rollers 14*b* and 14*c* are constructed in identical fashion.

Figure 3:
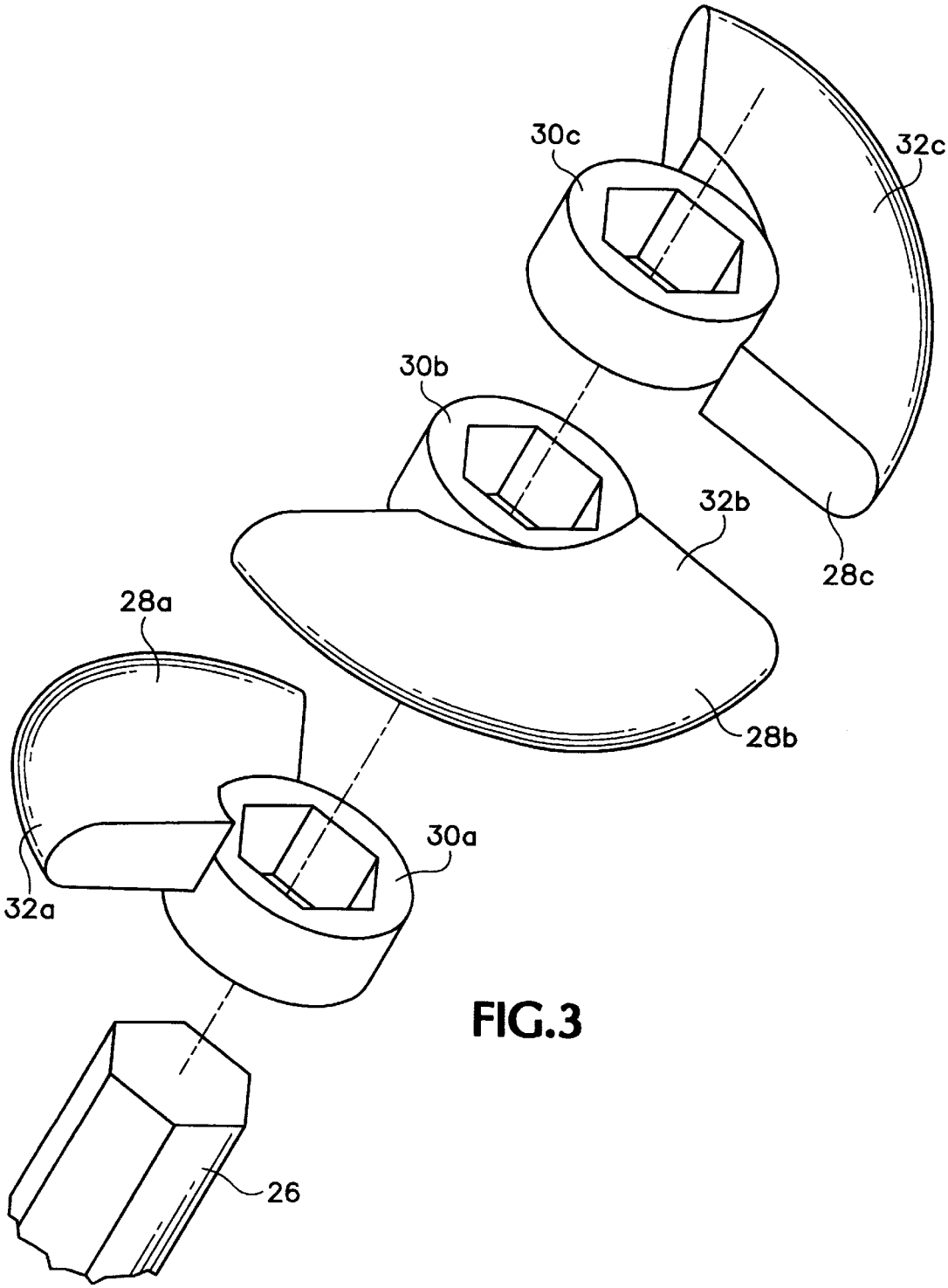
FIG. 3 is an exploded perspective view of a group of augur segments adapted for mounting on a hexagonal spindle shaft.

The variable pitch augurs 16*a*, 16*b* and 16*c* are also constructed in segments as shown in FIG. 2. In FIG. 3, a hexagonal shaft 26 which is identical to one of the spindle shafts 11 engages segments 28*a*, 28*b* and 28*c*. Each of the segments 28*a*, 28*b*, 28*c* includes a mounting aperture 30*a*, 30*b* and 30*c* which is a ring having a bore in a hexagonal shape to receive the shaft 26. The other portion of each of the augur segments 28*a*, 28*b* and 28*c* is a blade portion 32*a*, 32*b*, 32*c* which is a partial helix having a radial arc of approximately 120 degrees. Thus, three such segments when combined produce a complete turn of 360 degrees. In practice, however, the augur segments could be of any radial arc desired. Manufacturing considerations will largely dictate the size of the radial arc for each of the segments, but in general radial arcs between 90 degrees and 180 degrees work best.

In practice, the segments 28*a*, 28*b*, 28*c* may be of different pitch but still fit together to form a continuous helical spiral shape. In this way, the pitch may be changed from one portion of an augur to another in order to process different sizes of product on different portions of the table. Also, with different sized pitch segments, an augur may be constructed so that its pitch and variation of pitch are customized to the size distribution of the product being processed.

The sizing table has an input end 13 and an output end 15. Product is deposited at the input end 13 by any suitable means such as a conveyor or a vibratory feed table. As the augurs 16*a*, 16*b* and 16*c* turn along with the rollers 14*a*, 14*b* and 14*c*, product is both conveyed down the length of the table 10 and properly sized product is allowed to slip to the bins or conveyors below through the space between the augur and adjacent rollers. Only properly sized product can fall through the table into the designated receiving area and in order to fall through the table, the product, as illustrated in FIG. 2 as potatoes 35, will be prevented from falling through unless both thickness and length dimensions are correct. Long thin pieces of product will be carried on top of the augurs since the pitch will be too narrow for such potatoes to be caught by the blade portion of the helical augur but will merely ride on top of the augur as it is carried down the length of the table until its length and its thickness permit it to slide through. Product that is too thick (along the minor axis) will also be pushed downstream by the augurs until the aperture formed by the adjacent vanes at the augur in conjunction with the clearance between the vanes and adjacent rollers becomes large enough to allow the product to slip through.

What is claimed is:

1. A sizing apparatus for sorting product according to size comprising:

(a) a frame supporting a plurality of horizontally extending, parallel rotary spindles;

(b) a first group of said spindles supporting tapered rollers;

(c) a second group of said spindles interposed in alternating fashion with the first group, said second group of spindles supporting variable pitch augurs; and (d) a motor for imparting rotary motion to both groups of spindles.

2. The sizing apparatus of claim 1 wherein said apparatus includes an input end and an output end and said rollers are tapered so as to have progressively smaller diameters from said input end to said output end, and wherein the pitch of the augurs increases progressively from said input end to said output end.

3. The sizing apparatus of claim 1 wherein said variable pitch augurs each comprise a set of segments adapted to fit together to form a continuous helical spiral.

4. The sizing apparatus of claim 1 wherein the segments of the variable pitch augur each comprise a mounting portion having an aperture for receiving a spindle shaft and a generally partially helically shaped blade portion, the blade portion of each said segment extending for a radial arc of between 90 and 180 degrees.

5. The sizing apparatus of claim 1 wherein the tapered rollers are comprised of a set of frusto-conical segments abutting one another.

6. A product sizing table comprising a frame supporting a plurality of rollers arranged in alternating fashion with a plurality of augurs, the augurs having a selectively variable pitch and a motor coupled to the pluralities of rollers and augurs thereby causing said rollers and augurs to rotate.

7. The product sizing table of claim 6 wherein the rollers are tapered.

8. The product sizing table of claim 7 wherein the pitch of the augurs increases from one end of the sizing table to an opposite end, and the diameter of the rollers decreases from said one end of the sizing table to said opposite end.

9. The product sizing table of claim 7 wherein the rollers and the augurs are formed in segments that fit together on rotary spindles.

10. The product sizing apparatus of claim 9 wherein said augur is formed from segments having a radial arc length of between 90° and 180°.

* * * * *